US005354788A

United States Patent [19]

Johnson et al.

[11] Patent Number: 5,354,788

[45] Date of Patent: Oct. 11, 1994

[54] DIALDEHYDE MODIFIED PHENOLIC FOUNDRY SAND CORE BINDER RESINS, PROCESSES FOR MAKING SAME, AND PROCESS FOR PREPARING FOUNDRY CORES AND MOLDS EMPLOYING SAME

[75] Inventors: Calvin K. Johnson, Lockport; David R. Armbruster, Forest Park; Sudhir K. Trikha, Streamwood, all of Ill.

[73] Assignee: Borden, Inc., Columbus, Ohio

[21] Appl. No.: 118,698

[22] Filed: Sep. 10, 1993

Related U.S. Application Data

[63] Continuation of Ser. No. 858,576, Mar. 27, 1992, abandoned.

[51] Int. Cl.[5] ..... B22C 1/22

[52] U.S. Cl. ..... 523/145; 524/354; 524/593; 524/594; 106/490; 528/156

[58] Field of Search ..... 523/145; 524/354, 593, 524/594; 106/490; 528/156

[56] References Cited

U.S. PATENT DOCUMENTS

| | | | |
|---|---|---|---|
| 2,621,165 | 12/1952 | Brown | 528/156 |
| 2,912,402 | 11/1959 | Less et al. | 523/145 |
| 2,915,491 | 12/1959 | Smith | 523/145 |
| 3,395,125 | 7/1968 | Moyer | 528/245 |
| 3,878,159 | 4/1975 | Vargiu et al. | 523/145 |
| 3,915,925 | 10/1975 | Terron et al. | 523/145 |
| 4,013,629 | 3/1977 | Cummisford et al. | 260/123.7 |
| 4,100,137 | 7/1978 | Lemieux et al. | 526/21 |
| 4,320,043 | 3/1982 | Anderson | 523/144 |
| 4,426,467 | 1/1984 | Quist et al. | 523/145 |
| 4,468,359 | 8/1984 | Lemon et al. | 264/82 |
| 4,474,904 | 10/1984 | Lemon et al. | 523/146 |
| 5,089,540 | 2/1992 | Armbruster et al. | 523/213 |
| 5,190,993 | 3/1993 | Iyer | 523/145 |

FOREIGN PATENT DOCUMENTS

| | | |
|---|---|---|
| 56-112961 | 9/1981 | Japan . |
| 57-065716 | 4/1982 | Japan . |

OTHER PUBLICATIONS

Re. 32,7260Lemon et al. Jul. 1988.

Knop et al, Phenolic Resins–Chemistry Applications and Performances Springer–Verlag Berlin Heidelberg, 1985, p. 14.

*Primary Examiner*—Paul R. Michl

*Assistant Examiner*—John J. Guarriello

*Attorney, Agent, or Firm*—Roylance, Abrams, Berdo & Goodman

[57] ABSTRACT

A phenolic resole resin for use as a foundry binder which has been internally modified to reduce its hot strength and thereby enhance its shakeout property is disclosed. The resin is the reaction product of a phenolic compound; a dialdehyde; and formaldehyde. A process of preparing such resin is also disclosed, comprising first reacting the phenolic compound and the dialdehyde, and subsequently reacting the product with the formaldehyde. The resin may be, in a preferred embodiment, an ester-curable alkaline phenolic resin. Also disclosed are a raw batch formulation including the resin of the invention, and foundry articles prepared therefrom.

33 Claims, No Drawings

DIALDEHYDE MODIFIED PHENOLIC FOUNDRY SAND CORE BINDER RESINS, PROCESSES FOR MAKING SAME, AND PROCESS FOR PREPARING FOUNDRY CORES AND MOLDS EMPLOYING SAME

This application is a continuation of application Ser. No. 858,576, filed Mar. 27, 1992 now abandoned.

FIELD OF THE INVENTION

This invention relates to a particular sand core binder of reduced hot strength and improved shakeout property, and to a process for making such binder. More particularly, the invention relates to a phenolic binder, preferably an ester-curable alkaline phenolic binder, which has been internally modified to alter its thermal stability, thus enhancing its collapsibility, and to a process for making it.

BACKGROUND OF THE INVENTION

In making shaped metal articles, metal castings are typically made by pouring molten metal into molds which may be made of sand bonded with various types of organic or inorganic binders. When the casting is removed from the sand mold, the mold is disintegrated and cannot be reused, except to reclaim the sand for future molding operations. Molds may also be of a permanent type. Permanent molds are made of solid materials such as metal or graphite and often consist of two or more pieces that can be separated to remove the casting. After the casting is removed, the mold is reused.

Internal cavities within a metal casting are made by placing cores inside a mold before the metal is cast. The core must then be removed from the interior of the casting to leave the cavity thus formed.

Cores for metal castings generally are made with a particulate refractory material such as sand bonded with an inorganic or, more commonly, an organic binder. The organic binder must serve to maintain the physical integrity of the core until the metal solidifies but then must sufficiently decompose, due to the heat from the casting operation, to allow the removal of the sand from the casting. The removal of core sand is typically effected by a process called shakeout which involves mechanically vibrating and impacting a casting to free the sand, which then may be reclaimed and reused for subsequent casting operations.

Many different types of organic binders are used to make sand cores for metal castings and many different processes used to cure these binders. One type of binder consists primarily of a phenolic resole resin. Phenolic resoles are typically made by reacting 1.0 to 3.0 moles of formaldehyde with one mole of a phenolic compound using an alkaline catalyst. Such binders are classified as "thermosetting" in that heat alone will cure them, but can also be cured with acid catalysts either at room temperature or with the help of heat. Foundry sand core binders based on phenolic resins are known which are cured by the above processes.

In recent years, ambient temperature ester-curable alkaline phenolic resole resins have gone into widespread use. Such resin binder systems are disclosed, for example, in U.S. Pat. Nos. 4,426,467 and 4,474,904, in which lactones and carboxylic acid esters, respectively, are used as curing agents; and in 4,468,359, in which the esters are used in the gaseous or vapor phase.

One use for which these resins are eminently suited is as binders for making foundry sand molds and cores. They display high casting quality and hardness; are rapidly cured at ambient temperature; and they do not evolve pungent gases on their thermal decomposition. However, such resins have one inherent disadvantage in that, when used to make cores for some types of castings, these cores exhibit poor shakeout relative to some other types of organic binders. Such poor shakeout can occur when casting metals having low melting points are used, or when a large core size relative to the amount of metal being poured is used. Primarily, however, poor shakeout results when binders fail to decompose sufficiently after casting to allow the sand to be easily removed.

Reduced hot strength and enhanced collapsibility are also desirable properties for molding cores in that such properties help prevent a casting defect known as hot tearing: when molten metal is poured around a core, the metal begins to shrink as it solidifies and cools. In order to prevent the hot, shrinking casting from tearing, the core must be able to collapse to some extent; if it does not, hot tearing may result. The present invention also seeks to reduce this defect.

Thus, a method to reduce hot strength of binders used in foundry cores and to improve the shakeout characteristics of phenolic resole based sand binders would expand the market for these binders and be very desirable.

SUMMARY OF INVENTION

Accordingly, there has been discovered a foundry resin which does not have the aforedescribed drawbacks.

In accordance with this invention, there is provided such a phenolic resole resin which has been modified by reacting a dialdehyde with a phenolic compound to incorporate aliphatic linkages between some of the phenol molecules in order to decrease the thermostability of the resin. When used as a binder for foundry molds and cores, reduced hot strength and enhanced collapsibility result.

In one aspect, the invention provides a phenolic resole resin comprising:

(a) a phenolic compound;

(b) from about 0.4 moles to about 2.8 moles of formaldehyde per mole of phenolic compound; and (c) from about 0.05 moles to about 0.3 moles of a dialdehyde compound per mole of phenolic compound.

In another aspect, the invention pertains to a process for preparing a foundry mold or core having reduced hot strength and improved collapsibility.

In one embodiment, the invention is a process for preparing such a resin, comprising the steps of (a) reacting from about 0.05 to about 0.3 moles of a dialdehyde per mole of phenolic compound; and (b) subsequently reacting the product of (a) with from about 0.4 to about 2.8 moles of formaldehyde.

Step (a) is preferably performed under acid conditions and at a temperature range of about 70° C. to about 105° C. and step (b) is performed under basic conditions at a temperature of about 50° C. to about 100° C.

In another embodiment, the process comprises mixing foundry sand with a liquid ester curing agent and the resin of the present invention; discharging the resulting mixture into a pattern; and allowing the binder to cure.

In a different embodiment, the sand is first mixed with the resin of the present invention; the mixture discharged into a pattern; and cure of the binder effected by contact with an ester curing agent in the vapor phase.

In still another embodiment, the sand is first mixed with the resin of the present invention; the mixture discharged into a pattern; and cure effected by placing the pattern in an oven to employ heat to cure the mold or core.

In yet another embodiment, the sand is mixed with a resin of the present invention and an acid catalyst or latent acid catalyst. Depending on the amount and strength of the acid catalyst, the sand mixture may be placed in a pattern and allowed to cure at room temperature or cured with the help of heat by oven baking or by placing the sand in a preheated pattern.

Foundry mold and core compositions comprising an aggregate and the resin binder of the invention comprise another embodiment of this invention.

DETAILED DESCRIPTION OF THE INVENTION

The present invention was devised to facilitate "shakeout" of resin-bonded foundry sand subsequent to metal casting, and to reduce casting defects.

Metal castings are separated from sand cores and molds by shaking, vibrating or otherwise mechanically dismantling to loosen the used sand and break up lumps or aggregates. A common means of performing this operation involves vibrating a casting against a hard surface to dislodge the sand. Heat supplied by the molten metal during casting causes thermal breakdown of the resin binder, facilitating shakeout. Of course, the weaker the resin binder in the used molds or cores after the casting process, the easier it is to shakeout the residual sand. While "shakeout" problems usually occur in the removal of sand cores which form interior voids in a casting, in some cases sand molds external to the casting can also cause "shakeout" problems.

When resin sand binders such as phenolic resins which are relatively stable are used, thermal breakdown from the heat supplied from the molten metal may be insufficient to allow easy breakdown.

The present invention, then, seeks to reduce the thermal stability of the phenolic bonding resin. It has now been discovered that this may be achieved by incorporating units derived from certain dialdehydes into the structure of phenolic resins. It is believed that these dialdehyde units replace at least some of the methylene bridges normally present in the cured phenolic resole resin with higher aliphatic bridges, resulting in reduced thermal stability.

It has been known in the art to incorporate dialdehydes into phenolic resins which, in some cases, have been used as foundry sand binder resins, though not explicitly for the purpose of improving "shakeout". For example, Cummisford et al., U.S. Pat. No. 4,013,629, discloses the reaction of glyoxal with a polyhydroxyl component such as a polysaccharide, in the presence of a specific catalyst to slow down the reaction. While it is mentioned by way of background that polysaccharides may be crosslinked with phenolic resins, no mention is made of modifying phenolics with glyoxal or other dialdehyde.

It was also known that dialdehydes such as glyoxal could be used as the aldehyde component in preparing phenolic resins. However, because it was not yet known how to control the reaction and that the product could be optimized by balancing dialdehyde with formaldehyde, products were said not to have much commercial importance. See Knop et al., *Phenolic Resins-Chemistry Applications and Performance,* Springer-Verlag Berlin Heidelberg, 1985, p. 14.

Furthermore, Japanese Patent 56112961 discloses reaction of phenol with a portion of glyoxal or glutaraldehyde to make a modified novolak resin. However, no mention is made of ester curing, or the subsequent reaction with formaldehyde. Moreover, the resins disclosed in that patent are said to be strong at high temperatures.

The present invention, then, is, in part, in the discovery that the hot strength of phenolic resole sand binder resins can be reduced and collapsibility of cores and molds made with these resins improved by modifying these resins with certain dialdehydes.

THE RESIN AND PROCESS FOR MAKING

The resin per se is one comprising units from a phenol, a dialdehyde, and formaldehyde.

While ambient temperature, ester-curable alkaline phenolic resins will be described in particular detail hereinbelow, it should be appreciated that any phenolic resole resin which is prepared from a phenol and formaldehyde as known in the art may be dialdehyde-modified in accordance with this invention. Examples of phenolic resins which may be so modified include, but are not limited to, acid cured no-bake resins; ester-cured alkaline phenolic resins; and heat cured phenolic resins such as hot box resins and phenolic baking resins.

The phenol is any one typically used in the art of preparing phenolic resins, and may have one or more hydroxyl groups. Such compounds include phenol itself; substituted phenols including cresols; resorcinol; 3,5-xylenol; nonylphenol and other alkyl phenols; bisphenols such as bisphenol A; and other phenolic compounds. A preferred phenolic compound is unsubstituted phenol.

The phenol is first reacted with a dialdehyde, using an acid catalyst, to form aliphatic linkages between at least some of the phenol molecules. The dialdehyde is aliphatic in nature and may be about a three-carbon to twelve-carbon dialdehyde, wherein the carbons other than which are part of the aldehyde group are part of an aliphatic group, and wherein the aliphatic group between the aldehyde end groups may be a straight chain of about one to ten carbon atoms, or may be substituted in one or more positions with methyl, ethyl or propyl groups.

In general, then, the dialdehyde is represented by the formula:

$$HOC—(CRR^1)_n—COH$$

where n is an integer of from 1 to about 10, and where R and $R^1$ are independently selected from the group consisting of hydrogen and lower alkyl (e.g., methyl, ethyl or propyl) and mixtures of these.

Suitable aldehydes, then, would include: 1,3-propanedialdehyde; glutaraldehyde; 1,4-butanedialdehyde; 2-methyl, 1,3-propanedialdehyde; and the like. A preferred dialdehyde is glutaraldehyde.

About 0.05 to about 0.3 moles of dialdehyde per mole of phenol, and preferably about 0.1 moles to about 0.3 moles of dialdehyde per mole of phenol, are used for the acid catalyzed reaction. If less than about 0.05 moles of dialdehyde per mole of phenol are employed, inadequate modification of the resin will result relative to a non dialdehyde-containing phenol-formaldehyde resin. If more than about 0.3 moles of the dialdehyde per mole of phenol are used, the viscosity of the final resin at acceptable solids level may be too high.

The intermediate condensation product of the dialdehyde and the phenol is made in the presence of an acid catalyst at an elevated temperature. Any of the strong inorganic or organic acid catalysts that are typically used to prepare novolak-type resins may be used to catalyze this reaction. These include sulfuric acid, phosphoric acid, hydrochloric acid, oxalic acid and other strong acids. Typically, about 1% or less by weight of these acids are used based on the weight of phenol.

Typically, the reaction is performed at atmospheric pressure and at a temperature in the range of about 70° C. to about 105° C. and preferably at or near the boiling point of water, i.e., about 95° C. to about 105° C. If it is desired to perform the reaction at a higher temperature a pressure reactor may be used. The required reaction time will vary based on type of dialdehyde; type and amount of catalyst; and reaction temperature. Progress of the reaction may be monitored as is known in the art, such as by checking a physical property which changes as molecular weight increases (e.g., viscosity), or by analyzing for unreacted aldehyde. The reaction is considered completed when little or no unreacted aldehyde remains or when there is little or no viscosity increase with additional reaction time.

This intermediate product is further reacted with a formaldehyde using an alkaline catalyst to form the final resole resin. The reaction is typical of reactions well known in the art for resole resin formation. Typically, alkaline hydroxides such as $Ca(OH)_2$, NaOH or KOH; tetralkyl ammonium hydroxides; or amines are used as catalysts to react formaldehyde with a phenol at temperatures in the range of from about 50° C. to about 100° C. Preferably, the reaction takes place at a temperature in the range of about 65° C. to about 95° C. Catalyst levels can vary widely depending on catalyst type, reaction temperature, amount of catalyst needed in the final product and other factors. Resoles are typically made using about one to about three moles of formaldehyde per mole of phenol.

The resole of this invention is prepared by reacting the intermediate product with about 0.4 moles to about 2.8 moles, and preferably from about 0.6 moles to about 2.5 moles, of formaldehyde, based on moles of starting phenol, in the presence of an alkaline catalyst. By "formaldehyde" is meant water solutions of formaldehyde or paraformaldehyde or mixtures thereof. The amount of formaldehyde varies depending on the amount of dialdehyde used to prepare the intermediate and on the end use of the product. Because the dialdehyde replaces some of the formaldehyde used for cross-linking the cured resin, less formaldehyde would typically be used for a dialdehyde-modified resin than for a similar, non-modified resin.

In the preparation of the ester-curable alkaline phenolic resole resin, it is necessary for the resin to contain about 0.5 moles to about 1.0 moles of alkaline catalyst, and preferably between about 0.6 and about 0.9 moles of alkaline catalyst per mole of phenol in the resin. Alkaline catalyst is required in an amount sufficient to hydrolyze the amount of ester needed to effect the cure of the resin. The preferred alkaline catalyst is potassium hydroxide, though other alkaline catalysts, such as sodium hydroxide, lithium hydroxide, calcium hydroxide, tetraalkyl ammonium hydroxides, or amines may replace a portion of or, in some cases, all of the potassium hydroxide. Often these catalysts are used as water solutions. It is not necessary that all of the alkaline catalyst be present for the reaction of the intermediate with the formaldehyde. A portion can be used for this reaction and the remainder added in a later step or steps.

At least some of the alkaline catalyst, phenol-dialdehyde intermediate, and formaldehyde are reacted to make the resole. Aqueous solutions of formaldehyde are convenient to use and may be used at a concentration by weight of from about 37% to about 50%. The catalyst may be added all at once or incrementally, the latter to prevent the reaction from proceeding too rapidly.

Preferably, the exothermic heat of reaction is carried away by cooling water. The reaction is continued until a molecular weight providing the desired mold-or core-making properties is achieved. This molecular weight can be correlated with some physical property of the resin, such as viscosity, to determine when to stop the reaction. Often, reacting a resin for a given time at a given temperature is sufficient to control the extent of the reaction.

Once the reaction is essentially complete, the batch is cooled and water may be added or removed (dehydrated) to adjust viscosity to a desirable level, e.g., about 50 cps to about 400 cps, at 25° C.

Various additives may be added, as are known in the art. For example, a silane, such as aminopropyltriethoxysilane, or other silanes, may be used as an adhesion promoter. A formaldehyde scavenger such as urea may be used. Buffers, such as those made with organic acids and amines, may also be added. Finally, suitable solvents as are known in the art, such as methanol, ethanol, furfuryl alcohol, or phenoxy alcohol may be used, as may fluoro surfactants and antiskinning agents.

The binder of the present invention may be used to bond an aggregate such as foundry sand to form a foundry core or mold as is known in the art, in order to provide easy shakeout.

The sand which may be bonded with the modified binder of this invention may be any which is commonly employed in the foundry industry, including silica sand, quartz, chromite sand, zircon sand, olivine sand, or the like.

The binder, when mixed with the sand, comprises from about 0.8% to about 4% by weight of the sand, and preferably from about 1.0% to about 2.5%.

In a preferred embodiment, the dialdehyde modified resins are curable at ambient temperature using an ester curing agent. In this embodiment, a core or mold with reduced hot strength can be made by mixing sand, curing agent and the resin of this invention at ambient temperature; discharging the mixture into a pattern; and allowing the binder to cure to produce the mold or core.

Suitable ester curing agents for a no-bake process include lactones, organic carbonates, carboxylic acid esters and mixtures thereof. These species exhibit the ester functionality necessary for "ester-cure" of the alkaline phenolic resin.

Generally, low molecular weight lactones are suitable, such as gamma-butyrolactone, valerolactone, caprolactone, beta-propiolactone, beta-butyrolactone, beta-isobutyrolactone, beta-isopentylactone, gamma-isopentylactone and delta-pentylactone. Suitable carboxylic acid esters include, but are not limited to, n-butyl acetate, ethylene glycol diacetate, diacetin, glycerine tripropionate, triacetin (glycerol triacetate), dimethyl glutarate and dimethyl adipate and other $C_1$ to $C_{10}$ carboxylic acid esters.

Suitable organic carbonates include, but are not limited to, propylene carbonate, ethylene glycol carbonate, glycerol carbonate, 1,2-butanediol carbonate, 1,3-butanediol carbonate, 1,2-pentanediol carbonate and 1,3-pentanediol carbonate.

Phenolic resin-modified, ester cure-type hardeners as are described in U.S. Pat. Nos. 4,988,745 and 5,036,116 may also be used.

In yet another embodiment, a foundry core or mold is prepared by mixing sand with the resin of the invention; discharging the mixture into a pattern; and effecting cure by contact with a vaporous ester curing agent. In the "cold box" ester-cured embodiment, the dialdehyde-modified resin may also be cured by gassing with low molecular weight, gas phase carboxylic acid esters, such as $C_1$ to $C_3$ alkyl formates, including methyl formate and ethyl formate. Methyl formate is a preferred gaseous curing agent. The gaseous curing agent is preferably dispersed in a carrier gas as a vapor or an aerosol. This carrier gas should be inert so that it does not react with the alkyl formate curing agent or have some other adverse effect. Suitable examples of carrier gases include air and nitrogen.

The relative volatility of these alkyl formates enables their use as gaseous curing agents. Thus, methyl formate, which is a volatile liquid having a boiling point at atmospheric pressure of about 31.5° C., is a preferred curing agent. At ambient temperatures, it is sufficiently volatile that passing carrier gas through liquid methyl formate gives a concentrated methyl formate vapor. Ethyl and propyl formates are less volatile than the methyl ester, having boiling points in the range of 54° C. to 82° C. at atmospheric pressure.

The concentration of formate in the carrier gas is preferably at least 10% by volume and more preferably from about 30% to about 80% by volume. The total amount of alkyl formate used will typically be from about 10% to about 110%, preferably from about 15% to about 35% by weight, based on the weight of the phenolic resin solution. The time required for adequate gassing depends on the size and complexity of the core or mold and on the particular resin used. It can be very short, but typically is in the range of about 1 second to about 1 minute. The gassing procedure is described more particularly in U.S. Pat. No. 4,468,359.

While the inventors do not wish to be bound by any particular theory, the modification of the present invention is believed to decrease thermal stability by placing a number of aliphatic groups between some of the aromatic phenol molecules. Thus, while glutaraldehyde is the only dialdehyde exemplified herein, it should be appreciated that dialdehydes analogous to glutaraldehyde, which has five carbon atoms, the analogs having from three to twelve carbon atoms, are suitable for the present invention.

It should, again, be appreciated that, while a preferred type of resin which may be prepared in accordance with this invention is an ambient temperature-cured alkaline phenolic resole resin as described in detail hereinabove, other phenolic resins systems are likewise well suited.

For instance, acid-cured phenolic no-bake resins and baking resins, may be prepared which have the improved collapsibility of the present invention as the result of incorporation of dialdehyde linkages. For making acid-cured phenolic no-bake cores or molds, an organic sulfonic acid or other organic acid catalyst selected from the group consisting of toluene sulfonic acid, benzene sulfonic acid, xylene sulfonic acid and mixtures thereof, may be used.

The invention further concerns a process for preparing a foundry core or mold capable of easier shakeout, as well as the raw batch formulation used to prepare it and the foundry core or mold so prepared.

The foundry cores or molds which are bonded with the resins of this invention may be prepared in accordance with methods known in the art, such as are described in the aforementioned U.S. Pat. Nos. 4,468,359 and 4,474,904.

For example, the sand to be bonded may be mixed with ester curing agent in a laboratory sand mixer, the resin solution added and mixed, and the mixture discharged into molds or cores.

Alternately, the sand and resin may be mixed and discharged into a mold or core box, after which vaporous curing agent may be applied to effect cure.

In yet another embodiment, the sand, resin and an acid catalyst of the type described above are mixed; the mixture discharged into a pattern; and the resin binder allowed to cure, at room temperature or in the presence of heat.

In any case, the molds or cores which result have reduced hot strength and are capable of easy shakeout, which is performed, for example, by vibrating a sand-filled casting against a hard surface. Alternately, the cores may be broken down by heating the castings in an oven. Cores prepared in accordance with this invention will break down faster and shake out easier than conventional phenolic cores.

The invention is illustrated by the following Examples, which are intended merely for the purpose of illustration and are not to be regarded as limiting the scope of the invention or the manner in which it may be practiced. Unless specifically indicated otherwise, all parts and percentages given are on a weight basis, as is. Unless otherwise indicated, properties of resin coated sand prepared using the resin of the invention or control resins were measured using a Dietert-Detroit No. 785 Thermolab Dilatometer, a complete high temperature testing laboratory for mold and core sands from Harry W. Dietert Co., Detroit, Mich. The Dilatometer is described in Catalog 122 of the Harry W. Dietert Co. As described, Viscosity measurements reported in the Examples and Comparative Examples were made by one of two methods well known in the art. In the first method, a Brookfield viscometer, model RVF, spindle speed 20 at 25° C., was used, using either a number 3 or number 1 spindle. In the second method, a ball-and-tube method was used, wherein a 3/16" stainless steel ball was dropped through a glass tube of either 6.0 mm or 9.6 mm inside diameter positioned at a 20° incline in a water bath, and the time required for the ball to fall 10"through the tube was recorded. The tubes were precalibrated against a Brookfield viscometer to obtain a viscosity factor to standardize the measurements. In Example IV and Comparative Example IV, viscosities were measured by Brookfield viscometer; in the remaining Examples and Comparative Examples, the ball-and-tube method was used.

EXAMPLE I

A Glutaraldehyde-Modified Ambient Temperature Ester Cured Phenolic Resin Having Improved Shakeout This Example illustrates a resole resin prepared from glutaraldehyde, phenol and formaldehyde and having excellent shakeout properties. For each mole of phenol, this resin contained 0.21 moles of glutaraldehyde, 1.24 moles of formaldehyde and 0.63 moles of potassium hydroxide.

The dialdehyde-phenol intermediate was prepared as follows: 800 grams of phenol and a solution of 4 grams of 100% sulfuric acid in 10 grams of water were charged into a three-necked flask equipped with a stirrer, thermometer, reflux condenser and dropping funnel. The contents were heated to 90° C. using steam heat, after which 350 grams of a 50% solution of glutaraldehyde in water were added slowly through the dropping funnel over a period of about 20 minutes, while maintaining the batch temperature at about 90° C.

After addition of glutaraldehyde was completed, the batch was then reacted at 95° C. to 100° C. using full steam heat for six hours and the progress of the reaction was checked by measurement of viscosity every two hours. After two hours reaction time, the viscosity was 1908 cps at 25° C.; after 4 hours, 3371 cps; and after 6 hours, 3962 cps.

After essentially completing the reaction, the batch was cooled and 100 grams of water and 672 grams of 45% potassium hydroxide (aqueous) added. The batch temperature was adjusted to 70° C. and 634 grams of a 50% aqueous solution of formaldehyde added gradually, over a period of about 30 minutes, while maintaining the batch temperature at about 70° C. After addition of formaldehyde was completed, the batch was reacted at 70° C. for 45 minutes and then cooled.

Additives in the form of 99 grams of phenoxy ethanol (solvent); 10 grams of A1100 aminosilane (adhesion promoter, from Union Carbide) and 49 grams of a buffer solution comprising 60 parts by weight of triethanolamine, 20 parts of acetic acid and 20 parts of water were added to produce a final resin solution having a viscosity of 190 cps at 25° C. and a refractive index of 1.4878 at 25° C.

The resulting resin was tested for shakeout properties using the following method. 43.75 grams of this resin solution were coated onto 2500 grams of Wedron 530 sand using a Hobart Kitchen Aid mixer at speed 1 for three minutes. The resulting resin-coated sand was used to make four $1\frac{1}{8}'' \times 2''$ cylinder test specimens using a Dietert No. 754-A sand rammer.

The test core specimens so prepared were cured in the specimen tubes by gassing for ten seconds with a 60/40 mixture (by volume) of methyl formate gas and air. The cured specimen cores were removed from the specimen tubes for testing. The cores were tested using a Dietert No. 785 Thermolab Dilatometer with the furnace equilibrated at 1600° F. The core specimens were placed in the dilatometer equipped with an "own atmosphere" hood and subjected to a 50 psi compressive load. The time it took for a core to collapse was then measured, this time being directly related to the thermostability of the resin and, therefore, to the ease of shakeout. The cores, based on an average of four cores, required 215 seconds (3 minutes 35 seconds) to collapse.

EXAMPLE II

Another Glutaraldehyde-Modified Ambient Temperature Ester-Cured Phenolic Resin The same equipment and reaction procedures as were used in Example I were again used to prepare the resin of this Example. For each mole of phenol, this resin contained 0.23 moles of glutaraldehyde, 1.31 moles of formaldehyde and 0.80 moles of potassium hydroxide.

752 grams of phenol were reacted with 375 grams of a 50% solution of glutaraldehyde at 95° C. to 100° C. for 5 hours, using 3.7 grams of 100% sulfuric acid as catalyst. 796 grams of a 45% solution of potassium hydroxide were then added and 630 grams of a 50% solution of formalin (formaldehyde in water) added over a period of about 30 minutes at 65° C. The reaction was continued for 1 hour at 65° C. and then cooled. Progress of the reaction was checked by measurement of viscosity; the resin at this point in the reaction had a viscosity of 83 cps at 25° C.

Vacuum dehydration was then used to remove water and increase the viscosity to 145 cps at 25° C. To a portion of this dehydrated solution were added 3.5% (by weight) of phenoxyethanol and 0.33% of A1100 aminosilane (neat) from Union Carbide to give a final product having a viscosity of 206 cps and a refractive index of 1.5007.

This resin was tested for shakeout properties using the same equipment and procedure as described in Example I, except that the test temperature was 1800° F. rather than 1600° F. Collapse time was measured to be 139 seconds (2 min. 19 sec.) for an average of five cores.

CONTROL EXAMPLES I AND II

An Analogous Non Glutaldehyde-Modified Resin Having Poor Shakeout

A resin analogous to that prepared in Example I, but for being absent the glutaraldehyde modification, was used to coat sand and was tested for collapsibility in accordance with the method described in Examples I and II to provide a direct comparison visa vis improved collapsibility. Test specimens were made at the same time the specimens for Example I were made and collapsibility for Control Example I tested in the manner described in Example I and for Control Example II as in Example II.

The resin solution which was used for Control Examples I and II was BETASET 9512 alkaline phenolic resin, made and sold by Acme Resin Corporation. This resin solution was prepared from phenol, formaldehyde and potassium hydroxide catalyst in a mole ratio of 1.0:2.0:0.68, and had a viscosity of about 150 cps, a solids content of about 53%, specific gravity of about 1.25, pH of about 12.1, free phenol content of about 1.5%, free formaldehyde of 0.5% maximum and nitrogen content of about 1%. It included phenoxy ethanol, A1100 silane, urea and buffer. The resin was ester-cured by gassing, as in Example I.

When formed into test cores and subjected to the analysis described in Example I, an average collapsibility time for four cores of 332 sec. (5 min. 32 sec.) was measured (Control Example I). When subjected to the analysis described in Example II (at a higher test temperature), an average collapsibility time for five cores was measured at 240 sec. (4 min.) (Control Example II).

EXAMPLE III

A Phenolic No-Bake Resin Having Improved Shakeout

The same equipment and reaction procedures that were used in Example I were used to prepare the phenolic no-bake resin of this Example.

1098 grams of phenol, 4.4 grams of 100% sulfuric acid catalyst and 350 grams of a 50% solution of glutaraldehyde were reacted at 95° C. to 100° C. for six hours and cooled. 82 grams of a 25% solution of sodium hydroxide in water were then added and the batch temperature adjusted to 75° C. 664 grams of a 50% solution of formalin in water were added over a period of about 20 minutes. The reaction was continued at 75° C. for two hours after the addition to give a free formaldehyde level of 0.7%. 25 grams of glatial acetic acid were then added.

Water was removed by vacuum dehydration to an end point refractive index of 1.5470 and a viscosity of 2235 cps at 25° C. Eight grams of A1100 aminosilane (neat) from Union Carbide were added and the pH adjusted to 5.9 with 10 grams of acetic acid. This resin contains 0.15 moles of glutaraldehyde and 0.95 moles of formaldehyde for each mole of phenol.

The resin was tested for shakeout properties by the following method. 2500 grams of Wedron 530 sand were placed in a Hobart Kitchen Aid mixer. 12 grams of an acid catalyst containing 77 parts benzene sulfonic acid, ½ part of fluoroboric acid, 20 parts water and 3 parts methanol were added to the sand and mixed for 2 minutes. 30 grams of the resin prepared in this Example were then added and mixed for one minute. This coated sand was then used to make 1⅛"×2" cylinder specimens by ramming the sand into specimen tubes, where it self-hardened in about 17 minutes to a strength adequate to remove the specimen from the tube. The sand specimens were allowed to stand overnight before testing.

Testing was performed in the manner described in Example II (i.e., at 1800° F.). A collapse time of 266 seconds (4 min. 26 sec.) was measured as an average of four core specimens.

CONTROL EXAMPLE III

A Phenolic No-Bake Resin Analogous To Example III But Not Dialdehyde-Modified And Exhibiting Poor Shakeout Four cores were made up as described in Example III and tested for shakeout, except that an analogous, non dialdehyde-modified no-bake resin was used. The cores of Example III and Control Example III were made up and tested at the same time.

The control resin was 324 phenolic no-bake resin, sold by Acme Resin Corporation. This resin was made by reacting 1.25 moles of formaldehyde per mole of phenol using sodium hydroxide as the catalyst. It was neutralized with acetic acid and modified with an aminosilane. It had a refractive index of about 1.543 and a viscosity of about 150 cps at 25° C.

A collapse time for an average of four cores was measured to be 516 seconds (8 min. 36 sec.), nearly twice that of the dialdehyde-modified analog of Example III.

EXAMPLE IV

An Ambient Temperature Ester-Cured Alkaline Resin Having Good Shakeout 752 grams of phenol were charged into a three necked flask fitted with a stirrer, thermometer, condenser and a dropping funnel. A mixture of 3.7 grams of sulfuric acid and 10 grams of water was added to the flask to catalyze the reaction. The temperature of the contents was raised to 90° C. by applying steam to the flask. 375 grams of a 50% aqueous solution of glutaraldehyde were added slowly through the dropping funnel over a period of approximately 20 minutes, while maintaining the batch temperature at 90° C.

The batch was reacted under full steam heat (95° C. to 100° C.) for 5 hours. After 5 hours, the free glutaraldehyde content was measured using gas chromatography/Fourier transform-infrared spectroscopy. The free glutaraldehyde in the resin was 0.1% and its viscosity was 3278 cps, measured used a Brookfield viscometer, model RVF, spindle no. 3 at speed 20 and at 25° C.

The batch was cooled and 800 grams of a 45% solution of potassium hydroxide were added. The batch temperature was adjusted to 70° C. and 576 grams of a 50% aqueous solution of formaldehyde added over a period of approximately 30 minutes, while maintaining the batch temperature at about 65° C. to 70° C. After addition of formaldehyde was completed, the batch was reacted for 55 minutes at the same temperature. It was then cooled and 10 grams of Union Carbide A1100 aminosilane (neat), 100 grams of water and 90 grams of urea were added. The resulting resin had a viscosity of 152 cps (measured using spindle no. 1 of a Brookfield viscometer, model RVF, at 25° C.) and a refractive index of 1.492 at 25° C.

The procedure used for preparing test cores and determining their collapsibility characteristics was as follows: 2000 grams of Wedron 730 (washed and dried silica) sand were added to a Hobart Kitchen Aid mixer. 28.8 grams of resin were added to the sand and mixed for 1 minute. 8.6 grams of a curing agent which is a 70/30 blend of resin-modified butyrolactone/triacetin, available as ALpHACURE® 105 from Acme Resin Corporation, were added to the mixer and mixed for an additional 30 seconds.

The resulting sand-binder mix was immediately used to make 1⅛"×2" cylinder test specimens using a Dietert No. 754-A sand rammer. The test core specimens were allowed to cure in the specimen tubes at ambient temperature.

After approximately 10 minutes, the core specimens were removed from the specimen tubes when they had reached adequate handling strength and were allowed to cure further overnight. The collapse time of a core specimen was determined in the Dilatometer at 1800° F., while subjected to a 50 psi compressive load. An average collapse time based on four cores was determined to be 148 seconds (2 min. 28 sec.).

CONTROL EXAMPLE IV

An Ester-Cured Resin Which Is Not Glutaraldehyde Modified

An analogous resin to that described in Example IV, but not containing glutaraldehyde modification, was used to make up four cores which were tested in the manner described in Example IV. The resin used in this control Example was ALpHASET® 9025 resin, sold by Acme Resin Corporation. That resin was an alkaline phenolic resin containing about 2.1 moles of formaldehyde and about 0.74 moles of potassium hydroxide per mole of phenol. It was modified with urea and an aminosilane, and had a viscosity of about 155 cps, measured using a Brookfield viscometer, spindle No. 1, and a refractive index of about 1.499, both measured at 25° C.

An average collapse time for the four test cores made up from the control resin was measured at 242 seconds (6 min. 2 sec.).

EXAMPLE V

A Modified Ambient Temperature-Cured Phenolic Resin Having a Lower Glutaraldehyde Content 800 grams of phenol and a solution of 4 grams of 100% sulfuric acid in 10 grams of water were charged into a three necked flask with stirrer, thermometer, reflux condenser and dropping funnel. The mixture was heated to 90° C. and 170 grams of a 50% solution of glutaraldehyde in water were added gradually over a period of about 20 minutes. The resulting batch was reacted for five hours at full steam heat (about 95° C. to 100° C.). 0.1 moles of glutaraldehyde per mole of phenol were used.

The batch was then cooled, 50 grams of water and 672 grams of a 45% aqueous solution of potassium hydroxide added and the batch temperature adjusted to about 65° C. 742 grams of a 50% solution of formaldehyde in water were added over a period of about 30 minutes while maintaining the batch temperature at about 65° C. After addition of the formaldehyde solution was completed, the batch temperature was increased to about 80° C. and the reaction continued for 2 hours and 45 minutes until the resin viscosity reached 151 cps (measured at 25° C.).

The batch was cooled and 99 grams of phenoxy ethanol, 10 grams of Union Carbide A1100 silane and 49 grams of the buffer solution described in Example I were added. The resulting product mixture had a viscosity of 153 cps at 25° C. and a refractive index of 1.4963 at 25° C.

This resin mixture was tested for shakeout in the same manner as described in Example II, and a collapse time for an average of five cores was measured to be 225 seconds (3 min. 45 sec.).

CONTROL EXAMPLE V

An Analogous Non Glutaraldehyde-Modified Resin Having Somewhat Poorer Shakeout The control resin used in Control Examples I and II was again used to form cores and the resulting cores subjected to the same test procedures as in Example V. An average collapse time of 242 seconds (4 min. 2 sec.) was measured for an average of five cores.

CONCLUSION

This invention, then, consists of a modification of phenolic resole foundry sand binder resins with certain dialdehydes to reduce their thermostability. This modification reduces the hot strength of cores and molds made with these binders, which, in turn, improves their shakeout properties and hot tearing resistance, relative to prior art binders.

For example, the vapor phase ester-cured resins of this invention as depicted in Examples I and II showed about a 35% to 40% reduction in collapse time relative to the non modified controls, and the liquid ester-cured resins of Example IV, about a 40% reduction.

Furthermore, though most of this application has dealt with alkaline phenolic resins, it has been shown that other phenolic resole resins may be satisfactorily modified in accordance with this invention. The acid curable "no-bake" phenolic resin described in Example III, for instance, demonstrates reduced hot strength relative to the prior, non-modified control.

Also, it is shown in Example V that an improvement in collapse time is observed at mole ratios of glutaraldehyde to phenol as low as 1:10, although higher ratios are preferred.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art within the spirit of the invention and the scope of the appended claims.

What is claimed is:

1. A phenolic resole resin that is the reaction product of a phenolic compound, formaldehyde and an aliphatic dialdehyde, said resin comprising;

(a) a phenolic compound;

(b) from about 0.4 moles to about 2.8 moles of formaldehyde per mole of phenolic compound; and (c) from about 0.05 moles to about 0.3 moles of an aliphatic dialdehyde compound per mole of phenolic compound.

2. A phenolic resole resin according to claim 1 wherein said phenolic compound (a) is selected from the group consisting of phenol; substituted phenols; bisphenol; and mixtures thereof.

3. A phenolic resole resin according to claim 1 wherein said phenolic compound (a) is phenol.

4. A phenolic resole resin according to claim 1 wherein said dialdehyde compound (c) is selected from the group represented by the formula $$HOC—(CRR')_n—COH,$$

where n is an integer of from 1 to about 10 and R and R' are independently selected from the group consisting of hydrogen and a lower alkyl group, and mixtures thereof.

5. A phenolic resole resin according to claim 1 wherein said dialdehyde compound (c) is glutaraldehyde.

6. A phenolic resole resin according to claim 1 comprising from about 0.1 moles to about 0.3 moles of dialdehyde per mole of phenolic compound.

7. A phenolic resole resin according to claim 1 comprising from about 0.6 moles to about 2.5 moles of formaldehyde per mole of phenolic compound.

8. A phenolic resole resin according to claim 1 which is selected from ester-curable alkaline phenolic resins; acid curable no-bake phenolic resins; and heat curable phenolic resins.

9. A phenolic resole resin according to claim 1 which is an ester-curable alkaline phenolic resin.

10. A process for preparing a phenolic resole resin comprising steps of:

(a) reacting from about 0.05 to about 0.3 moles of an aliphatic dialdehyde per mole of a phenolic compound;

(b) subsequently reacting the product of (a) with from about 0.4 to about 2.8 moles of formaldehyde per mole of phenolic compound.

11. A process according to claim 10 wherein said step (a) is performed under acid conditions.

12. A process according to claim 10 wherein said step (b) is performed under basic conditions.

13. A process according to claim 10 wherein said phenolic resin is selected from ester-curable alkaline phenolic resins; acid curable no-bake phenolic resins; and heat curable phenolic resins.

14. A process according to claim 10 wherein said phenolic resin is an ester-curable alkaline phenolic resin.

15. A process according to claim 14 wherein said phenolic resole resin binder includes from about 0.5 moles to about 1.0 mole of an alkaline catalyst per mole of phenolic compound in the resin.

16. A process according to claim 10 wherein from about 0.1 to about 0.3 moles of dialdehyde are reacted per mole of phenolic compound in step (a).

17. A process according to claim 10 wherein from about 0.6 to about 2.5 moles of formaldehyde are reacted with the product of step (a) in step (b).

18. A process according to claim 10 wherein said step (b) is performed at a temperature in the range of about 50° C. to about 100° C.

19. A process according to claim 10 wherein said dialdehyde in step (a) is glutaraldehyde.

20. A process according to claim 10 wherein said phenolic compound in step (a) is phenol.

21. A process for preparing a foundry core or mold with reduced hot strength comprising (i) mixing foundry sand with an ester curing agent capable of curing alkaline phenolic resole resin binder at ambient temperature and an alkaline phenolic resole resin;

(ii) discharging the resulting mixture into a pattern; and (iii) allowing said resin binder to cure to produce a mold or core, wherein said phenolic resin binder (i) comprises:

(a) a phenolic compound;

(b) from about 0.4 moles to about 2.8 moles of formaldehyde per mole of phenolic compound; and (c) from about 0.05 moles to about 0.3 moles of an aliphatic dialdehyde compound.

22. A process according to claim 21 wherein said alkaline phenolic resole resin binder includes from about 0.5 moles to about 1.0 mole of an alkaline catalyst per mole of phenolic compound in the resin.

23. A process according to claim 21 wherein said cure in step (iii) is effected in the presence of heat.

24. A process for preparing a foundry core or mold with reduced hot strength comprising the steps of:

(i) mixing foundry sand with an alkaline phenolic resole resin binder;

(ii) discharging the resulting mixture into a pattern;

(iii) effecting cure of said resin by contacting same with a vaporous ester curing agent, wherein said phenolic resin binder in (i) comprises (a) a phenolic compound;

(b) from about 0.4 to about 2.8 moles of formaldehyde per mole of phenolic compound; and (c) from about 0.05 moles to about 0.3 moles of an aliphatic dialdehyde compound.

25. A process according to claim 24 wherein said vaporous ester curing agent is methyl formate.

26. A process for preparing a foundry core or mold with reduced hot strength comprising the steps of:

(i) mixing foundry sand with a phenolic resole resin binder and an acid catalyst;

(ii) discharging the resulting mixture into a pattern;

(iii) allowing said resin binder to cure, at room temperature or in the presence of heat, to produce a mold or core, wherein said phenolic resin binder in (i) comprises (a) a phenolic compound;

(b) from about 0.4 moles to about 2.8 moles of formaldehyde per mole of phenolic compound; and (c) from about 0.05 moles to about 0.3 moles of an aliphatic dialdehyde compound.

27. A process according to claim 26 wherein said acid catalyst is an organic sulfonic acid selected from the group consisting of toluene sulfonic acid, benzene sulfonic acid, xylene sulfonic acid and mixtures thereof.

28. The phenolic resin prepared according to the process of claim 10.

29. A composition for use in making foundry molds and cores with reduced hot strength comprising a mixture of (A) an aggregate, (B) an aqueous solution of a phenolic resin that can cure at ambient temperature with a curing agent having ester functionality, and (C) a curing agent effective for curing said resin in an amount sufficient to cure said resin under ambient conditions in the desired shape, wherein said phenolic resin in (b) comprises (a) a phenolic compound;

(b) from about 0.4 to about 2.8 moles of formaldehyde per mole or phenolic compound; and (c) from about 0.05 moles to about 0.3 moles of an aliphatic dialdehyde compound.

30. A foundry core or mold prepared according to the process of claim 21.

31. A foundry core or mold prepared according to the process of claim 24.

32. A foundry core or mold prepared according to the process of claim 26.

33. A foundry core or mold having reduced hot strength comprising (A) an aggregate, and (B) an ester-cured phenolic resole resin comprising (a) a phenolic compound;

(b) from about 0.4 to about 2.8 moles of formaldehyde per mole of phenolic compound; and (c) from about 0.05 moles to about 0.3 moles of an aliphatic dialdehyde compound.

* * * * *